US005424603A

United States Patent [19]

Van Den Bekerom

[11] Patent Number: 5,424,603

[45] Date of Patent: Jun. 13, 1995

[54] COLOR SELECTION MEANS FOR COLOR DISPLAY TUBES

[75] Inventor: Peter P. W. L Van Den Bekerom, Portschach, Austria

[73] Assignee: U.S. Philips Corporation, New York, N.Y.

[21] Appl. No.: 156,147

[22] Filed: Nov. 22, 1993

[30] Foreign Application Priority Data

Nov. 23, 1992 [EP] European Pat. Off. ..... 92203604

[51] Int. Cl.[6] ..... H01J 29/07

[52] U.S. Cl. ..... 313/407; 313/402; 313/408

[58] Field of Search ..... 313/402, 407, 408, 403, 313/404, 405, 406

[56] References Cited

U.S. PATENT DOCUMENTS 4,599,533 7/1986 Ragland, Jr. ..... 313/407
5,270,612 12/1993 Fogelsom ..... 313/407

FOREIGN PATENT DOCUMENTS 2210298 6/1989 United Kingdom .

OTHER PUBLICATIONS

Tetzner, Neue Masken fur hellere Bilder, Funkschau 11, 1989, pp. 49–54.

*Primary Examiner*—Donald J. Yusko
*Assistant Examiner*—Nimesh D. Patel
*Attorney, Agent, or Firm*—Paul R. Miller

[57] ABSTRACT

Color selection means for color display tubes is provided comprising a curved mask and a rectangular frame supporting the mask, which frame comprises four parts. To realize a light and nevertheless rigid frame construction, at least two oppositely located frame parts are formed by folded pipes which each have a re-entrant wall with an edge following a curved path. The mask is clamped onto these edges so that the curvature of the edges determines the curvature of the mask.

5 Claims, 2 Drawing Sheets

COLOR SELECTION MEANS FOR COLOR DISPLAY TUBES

BACKGROUND OF THE INVENTION

The invention relates to a colour selection means for colour display tubes, comprising a curved mask which is secured to a frame, which frame comprises a plurality of interconnected parts each forming a side of the frame.

A colour display tube with a colour selection means usually comprises a display screen having a pattern of lines or dots of an electroluminescent material, and an electron gun for generating electron beams, in which the colour selection means, which may comprise a wire mask or an apertured mask, is arranged between the electron gun and the display screen. The mask is a thin metal foil having a large number of apertures and should be arranged very accurately and very close to the display screen so that the mask apertures are systematically aligned with respect to the luminescent lines or dots on the display screen. To maintain the systematic alignment, the mask should be suspended in the colour display tube in an appropriate manner in order that the mask remains in an accurately determined position both during its manufacture and during operation of the tube. To realise this, a frame supporting the mask and being suspended in the tube is used. The frame is generally rectangular, but may alternatively be, for example square-shaped or elliptical.

In the case of a mask having a single (for example, cylindrical) curvature a frequently used construction is one in which a rigid and heavy frame is provided with the correct curvature, whereafter the mask is secured at the curved sides. In the case of a mask having a double curvature an example of a frequently used construction is the one in which the supporting frame comprises four L-shaped metal parts whose ends are interconnected and thus constitute a rectangular frame. See, for example Funkschau 11, 1987, pp. 49–54 ("Neue Masken für hellere Bilder"). In this case the desired accuracy is achieved by giving the mask the correct shape in advance (by means of deep-drawing) so that it will have a sufficient rigidity of itself. Reaching the desired accuracy by means of a metal-cutting finishing operation of a rigid and heavy frame, as well as deep-drawing of the mask has its drawbacks.

SUMMARY OF THE INVENTION

It is an object of the invention to provide a colour selection means construction in which the required accuracy is achieved in a different manner.

According to the invention, a colour selection means of the type described in the opening paragraph is characterized in that at least two oppositely located frame parts are each formed by a pipe folded from a sheet and having a first long pipe side which has an edge following a curved path, a second long pipe side which has a plurality of lugs connected to the first pipe side along a path which does not project beyond the curved path, and at least one third pipe side which is located between the first and the second pipe side, the mask closely engaging the edge of each first pipe side. The first long pipe sides may be situated at the outer side of the frame and the mask may have bent edges with which it is secured to the first long pipe sides. However, the first long pipe sides are preferably re-entrant and the mask is secured to the second pipe sides by the lugs.

The invention is based on the recognition that by decoupling accuracy and rigidity or fixation a curved construction of sheet material for the frame parts is possible without any finishing treatment. This recognition is elaborated in the use of pipes folded from sheet material. A part for forming a pipe can very accurately be cut from sheet material. Particularly, this part may have an edge which very accurately follows a path having a desired curvature. The mask engages this edge when the colour selection means is ready. Consequently, the mask acquires the desired curvature. The rigidity is obtained by the use of a "closed" pipe. The pipe is closed by providing one side which in the unfolded state is furthest remote from the curved edge with lugs and by securing these lugs to the side being provided with the curved edge after these lugs have been bent and after the pipe has been closed such as, for example, by welding or a mechanical connection technique. After the mask has been positioned or clamped onto the curved edge, it is secured to this side.

By not giving all lugs the same length, it is also possible to give the overall construction a curvature transverse to the curved edge so that the pipe is straightened if the mask is clamped onto the edge.

The invention also relates to a colour display tube provided with a colour selection means as described hereinbefore.

These and other aspects of the invention will be apparent from and elucidated with reference to the embodiments described hereinafter.

BRIEF DESCRIPTION OF THE DRAWING FIGURES

In the drawings

Figure 5A:
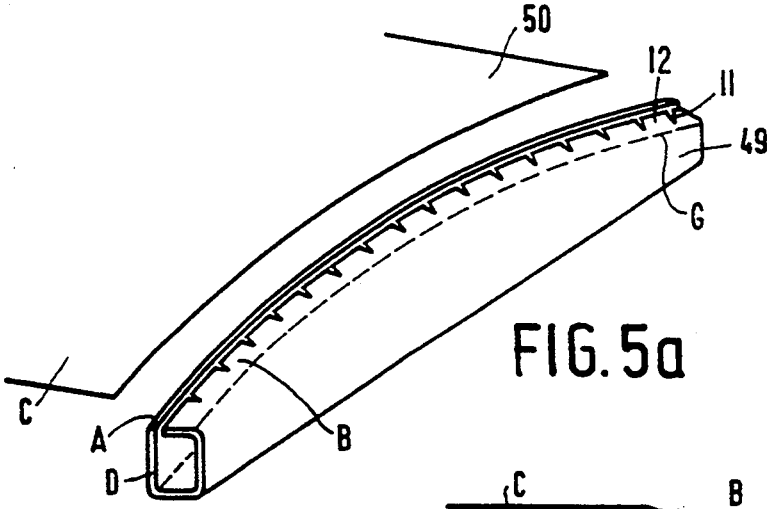
Figure 5B:
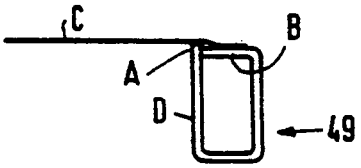
Figure 5C:
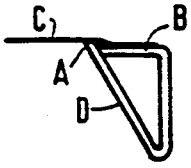
Figure 6A:
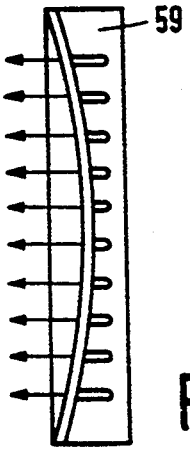
Figure 6B:
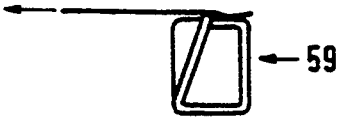

FIG. 5*a* shows a side of a colour selection means according to the invention;

FIG. 5*b* is a diagrammatical cross-section of a first embodiment of a pipe for the supporting frame of a colour selection means;

FIG. 5*c* is a diagrammatical cross-section of a second embodiment;

FIG. 6*a* is a plan view of a third embodiment of a pipe for the supporting frame of a colour selection means, and FIG. 6*b* is a cross-section through the construction of FIG. 6*a*.

DESCRIPTION OF THE INVENTION

Figure 1:
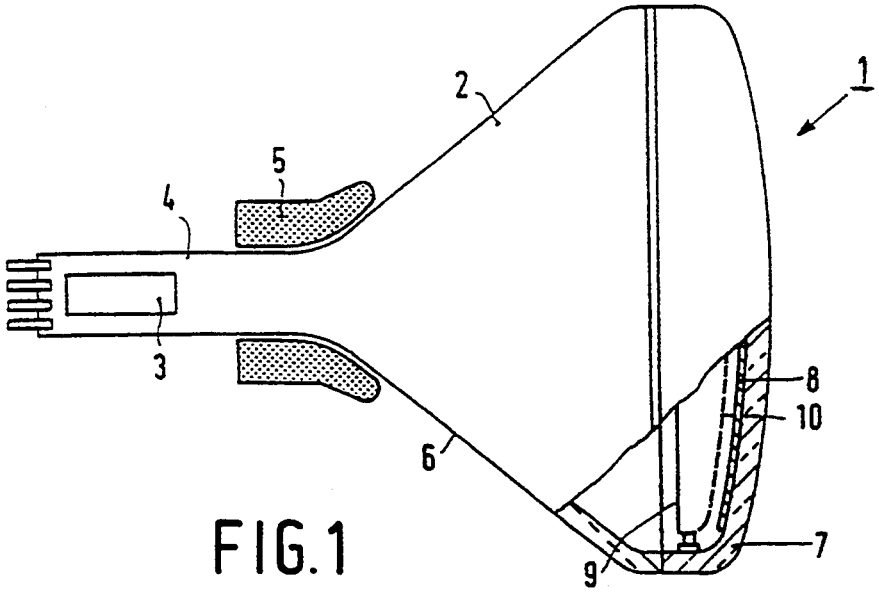
FIG. 1 is a side elevation, partly broken away, of a colour display tube with a colour selection means.

The cathode ray tube 1 shown in FIG. 1 comprises an evacuated glass envelope 2 with a neck 4, a funnel-shaped part 6 and a front panel 7 having a curved inner surface on which a display screen 8 having a pattern of, for example lines or dots of phosphors luminescing in different colours (for example red, green and blue) may be arranged. A rectangular frame 9 supports a thin mask 10 at a small distance from the display screen 8. The mask may be an apertured mask having circular or elongated apertures, or a wire mask. During operation of the tube an electron gun system 3 arranged in the tube neck sends electron beams through the mask to the display screen so that the phosphors will emit light. A deflection device 5 ensures that the electron beams systematically scan the display screen.

Figure 2:
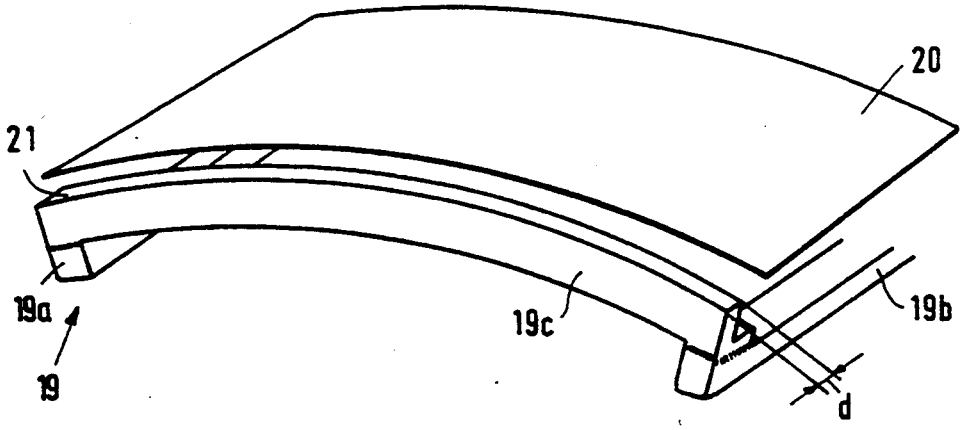
FIG.2 PRIOR ART
FIG. 2 is an elevational view of a known colour selection means with a mask having a single curvature.

FIG. 2 is an elevational view of a part of a known single curved mask 20 and a rectangular metal frame 19 onto which it is clamped. The frame comprises four solid frame parts (19*a*, 19*b*, 19*c*, 19*d*), two of which are curved (the parts 19*c* and 19*d*-the latter not being visible-) and two of which are straight (the parts 19*a* and 19*b*). The ends of the parts are interconnected. The curved parts 19*c*, 19*d* each have a relatively large thickness d. This relatively large thickness is dictated by the requirement that it must be possible to weld the mask on the upper surface 21 (the clamping edge) of the parts 19*c*, 19*d* and by the requirement that the frame should be sufficiently rigid. To give the mask a sufficiently accurate curvature, the upper surface 21 may be subjected to a metal-cutting finishing operation, such as grinding.

Figure 3:
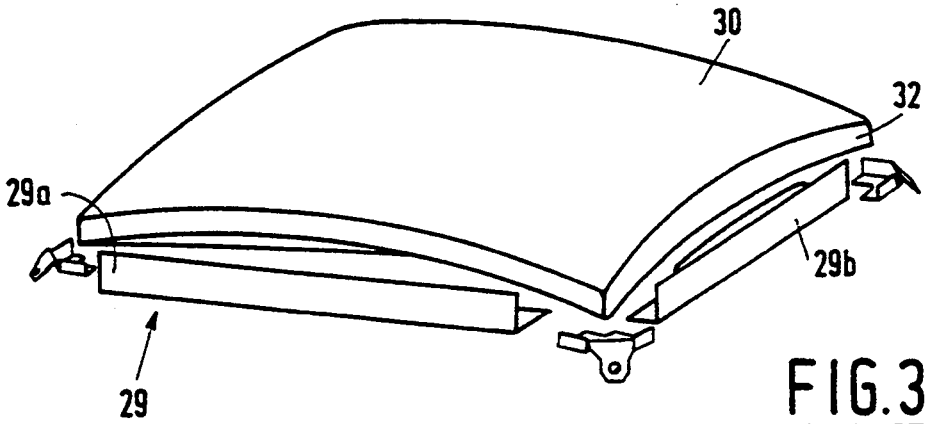
FIG.3 PRIOR ART
FIG. 3 is an elevational view of a known colour selection means with a mask having a double curvature.

FIG. 3 is an elevational view of a part of a known, double-curved mask 30 and two L-shaped parts 29*a*, 29*b* (of a total of four) of a rectangular metal frame 29 on which it is secured. In such a mask 30 the desired curvature of the mask is obtained by means of a deep-drawing process in which a skirt 32 is formed on the mask 30. Particularly in masks of a nickel-iron alloy having a coefficient of expansion this deep-drawing process is complicated, while there are limits to the accuracy to be achieved.

Figure 4:
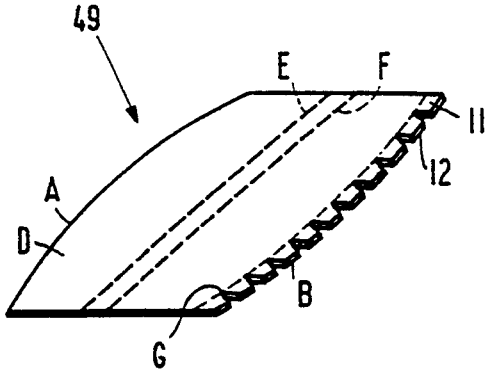
FIG. 4 shows a pipe according to the present invention for a supporting frame in an unfolded form.

FIG. 4 shows an embodiment of a supporting part (pipe 49) for a mask frame according to the invention in an unfolded state. The supporting part 49 is cut from a metal sheet, while particularly the edge A follows a very accurate curvature. The cutting process provides great accuracy. Two (imaginary) folds are present in the central area of the supporting part. The edge B located opposite the edge A is provided with a plurality of lugs 11, 12, etc. To form a pipe, the lugs 11, 12, etc. are bent along the fold G to a position transverse to the plane of the supporting part 49 in the unfolded state. Subsequently, the plate-shaped supporting part 49 is closed around the folds E, F and the welding lugs 11, 12, etc. are secured to the oppositely located wall D (by means of welding or a mechanical connection technique). This is performed in such a way that the bent lugs follow a curved path which is located slightly below the edge A. The pipe obtained is shown in FIG. 5*a*. A mask 50 is clamped onto the edge A and secured to the surface by means of the welding lugs 11, 12, etc. (FIG. 5*a*). The pipe of the supporting frame located opposite the pipe may be formed in the same manner as the pipe, as an alternative to the FIG. 2 construction. As an alternative to the FIG. 3 construction, the supporting frame may have four pipes formed in the manner as shown in FIGS. 4 and 5.

The pipe formed may have four sides as is shown in the cross-section in FIG. 5*b*, or in an alternative form it may have three sides (FIG. 5*c*).

By not giving all lugs 11, 12 etc. the same length, it is also possible to give the overall pipe construction a curvature perpendicular to the curvature of the edge A so that the pipe is straightened when the mask is tensioned (FIG. 6*a*). In this case the lengths decrease from the two ends of the supporting part 59 toward the center.

I claim:

1. A colour selection means for colour display tubes, comprising a curved mask which is secured to a frame, which frame comprises a plurality of interconnected parts each of said parts forming a side of the frame, characterized in that at least two oppositely located frame parts are each formed by a pipe folded from a sheet and having a first long pipe side which has an edge following a curved path, a second long pipe side which has a plurality of lugs connected to the first pipe side along a path which does not project beyond the curved path, and at least one third pipe side which is located between the first and the second pipe side, the mask closely engaging the edge of each first pipe side.

2. A colour selection means as claimed in claim 1, characterized in that the first long pipe sides are reentrant and the mask is secured to the second long pipe sides.

3. A colour selection means as claimed in claim 2, characterized in that the lugs have lengths which decrease from the two ends of the pipe toward the center.

4. A colour display tube provided with a colour selection means as claimed in claim 1.

5. A colour selection means as claimed in claim 1, characterized in that the lugs have lengths which decrease from the two ends of the pipe toward the center.

* * * * *